US008177233B2

(12) United States Patent
Grayson

(10) Patent No.: US 8,177,233 B2
(45) Date of Patent: May 15, 2012

(54) CUPS AND GAMES OF SKILL INVOLVING SUCH CUPS

(75) Inventor: John Charles Grayson, Savannah, GA (US)

(73) Assignee: Dorothy Theresa Grayson, Savannah, GA (US)

( * ) Notice: Subject to any disclaimer, the term of this patent is extended or adjusted under 35 U.S.C. 154(b) by 283 days.

(21) Appl. No.: 12/688,170

(22) Filed: Jan. 15, 2010

(65) Prior Publication Data

US 2010/0181718 A1 Jul. 22, 2010

Related U.S. Application Data

(60) Provisional application No. 61/145,196, filed on Jan. 16, 2009.

(51) Int. Cl.
*A63B 71/02* (2006.01)

(52) U.S. Cl. ..... 273/118 R; 273/127 B

(58) Field of Classification Search ..... 273/118 R, 273/127 R, 127 B; 473/173–175; D21/791
See application file for complete search history.

(56) References Cited

U.S. PATENT DOCUMENTS 1,136,153 A * 4/1915 Martineau et al. ..... 273/123 R
1,229,766 A * 6/1917 Long ..... 473/187
1,287,903 A * 12/1918 Daily ..... 473/180
1,691,935 A * 11/1928 Paterson ..... 473/189
D211,651 S * 7/1968 Cohen ..... D21/790
3,434,720 A * 3/1969 Hall ..... 473/185
3,434,721 A * 3/1969 Travers ..... 473/185
4,148,487 A * 4/1979 Bouve ..... 273/127 B
4,429,882 A * 2/1984 Stanton ..... 473/180
4,647,047 A * 3/1987 Little ..... 473/187
4,878,671 A * 11/1989 Gubany ..... 473/195
4,925,191 A * 5/1990 Ogilvie ..... 473/189
5,257,808 A * 11/1993 Mueller et al. ..... 473/174
5,275,404 A * 1/1994 Dimaano et al. ..... 473/180
5,487,545 A * 1/1996 Schindler ..... 473/187
D385,610 S * 10/1997 McDonald ..... D21/790
D400,631 S * 11/1998 Moore ..... D21/791
5,997,406 A * 12/1999 Selton ..... 473/180
5,997,407 A * 12/1999 Alexandres ..... 473/180
6,663,495 B2 * 12/2003 Fun ..... 473/180
7,914,387 B1 * 3/2011 Gugliotti ..... 473/174
2006/0135275 A1 * 6/2006 Kramer ..... 473/174
2007/0246882 A1 * 10/2007 DiFrancesco ..... 273/123 R
2009/0029788 A1 * 1/2009 Patterson ..... 473/174

* cited by examiner

*Primary Examiner* — Raleigh W. Chiu
(74) *Attorney, Agent, or Firm* — Thomas, Kayden, Horstemeyer & Risley, LLP

(57) ABSTRACT

Cups and games of skill involving such cups are provided. A representative cup includes: an aperture communicating with a cavity; and a barrier extending partially about the periphery of the aperture such that a portion of the cup lacking the barrier forms a lateral entrance to the cavity, the barrier having an upwardly and outwardly sloping first portion and a downwardly and outwardly sloping second portion, the first portion being located between the second portion and the aperture.

20 Claims, 3 Drawing Sheets

CUPS AND GAMES OF SKILL INVOLVING SUCH CUPS

CROSS REFERENCE TO RELATED APPLICATION

This application is a utility application that claims the benefit of and priority to U.S. Provisional Patent Application 61/145,196, filed Jan. 16, 2009, which is incorporated by reference herein in its entirety.

BACKGROUND

1. Technical Field

The disclosure generally relates to sports equipment.

2. Description of the Related Art

Many games of skill are known that involve the tossing or throwing of an object at a target. Horseshoes is a well known example that involves a horseshoe being tossed at a driven stake. Other games, such a bocce ball, involve throwing a ball at a target (e.g., another ball). Typically, a high score in such a game is related to how close the tossed horseshoe or ball lands to the target.

SUMMARY

Cups and games of skill involving such cups are provided. In this regard, an exemplary embodiment of a cup comprises: an aperture communicating with a cavity; and a barrier extending partially about the periphery of the aperture such that a portion of the cup lacking the barrier forms a lateral entrance to the cavity, the barrier having an upwardly and outwardly sloping first portion and a downwardly and outwardly sloping second portion, the first portion being located between the second portion and the aperture.

An exemplary embodiment of a game comprises: a cup having an aperture communicating with a cavity and a barrier extending partially about the periphery of the aperture; and a projectile sized to fit within the cavity via the aperture; the cup being configured such that, as a base of the barrier is in contact with an upper surface of soil, the cavity extends below the upper surface of the soil to form a hole into which the projectile is directed.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Figure 1:
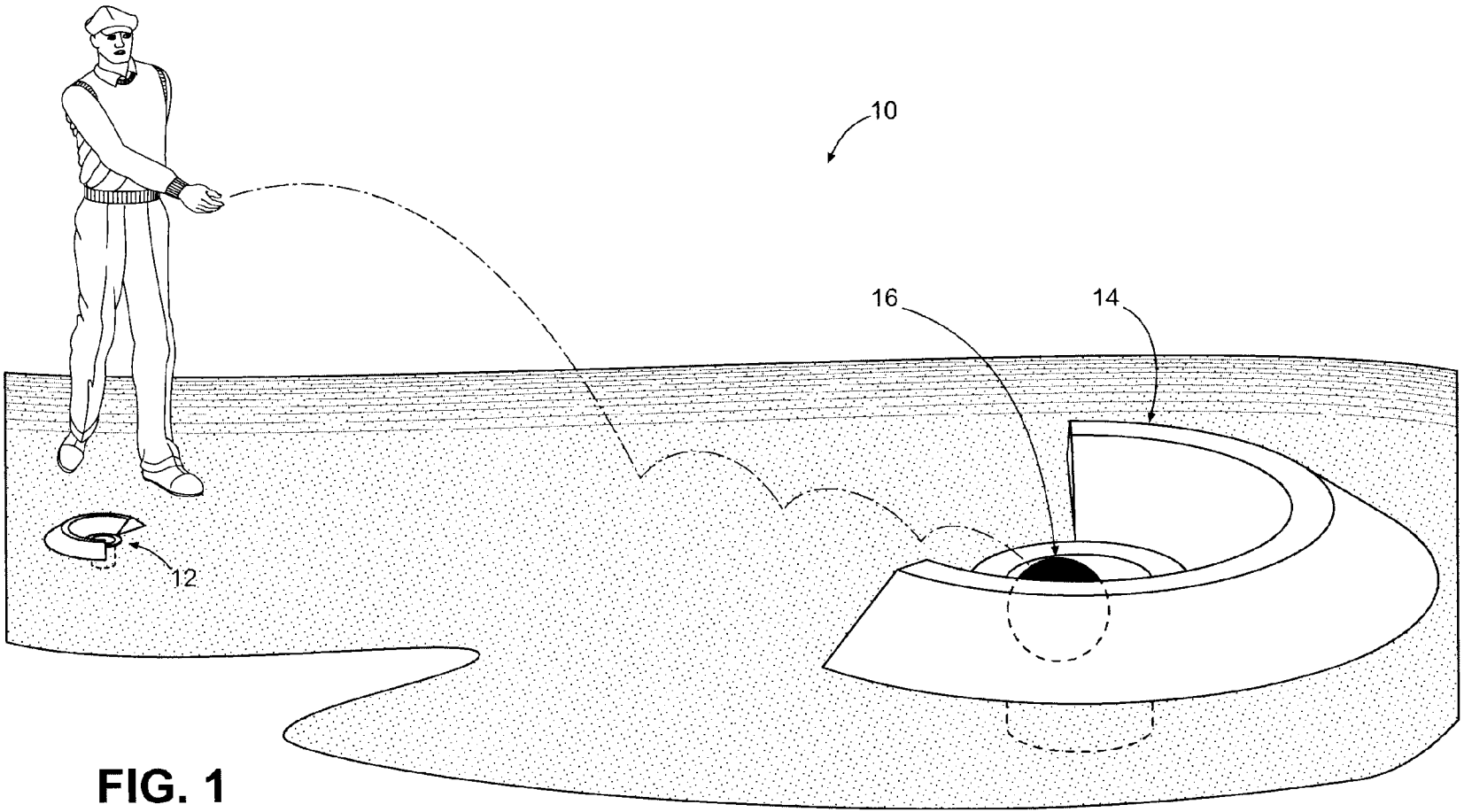
FIG. 1 is a schematic diagram depicting an exemplary embodiment of a game including two cups and a projectile.

FIG. 1 is a schematic diagram depicting an exemplary embodiment of a game 10 including two cups 12, 14 and at least one projectile (e.g., projectile 16). In this regard, the cups can be used to play a game similar in some respects to the game of Horseshoes. Specifically, cups 12, 14 are spaced from each other by some distance—say, 21 feet. A member of one team stands near one cup and a member of the other team stands near the other cup. Each team member then tries to get his projectile into the others' cup. This can be done by throwing, rolling, bouncing, etc. Scoring can be based, for example, on whether or not the projectile ends up in the cavity of the corresponding cup.

Figure 2:
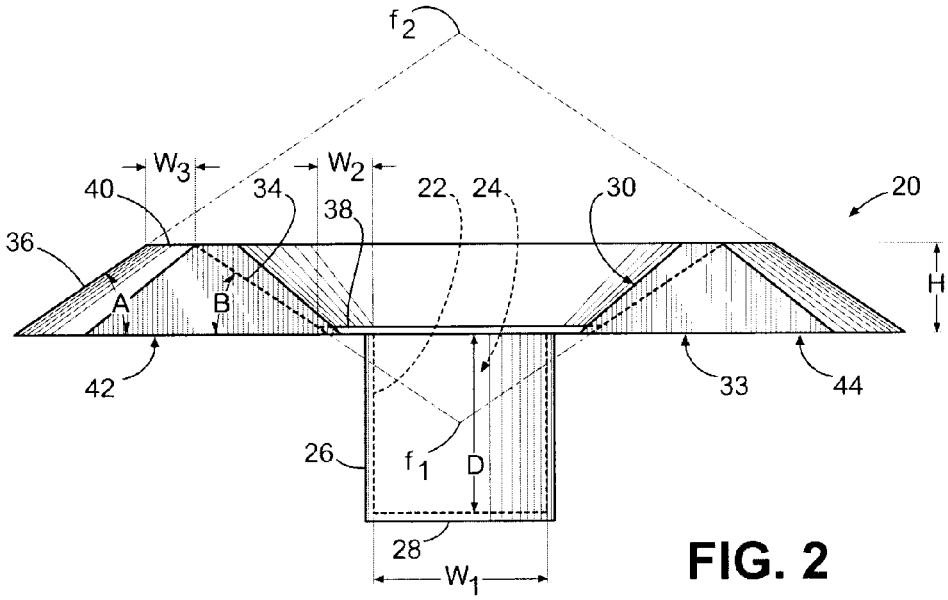
FIG. 2 is a side view of an exemplary embodiment of a cup.
Figure 3:
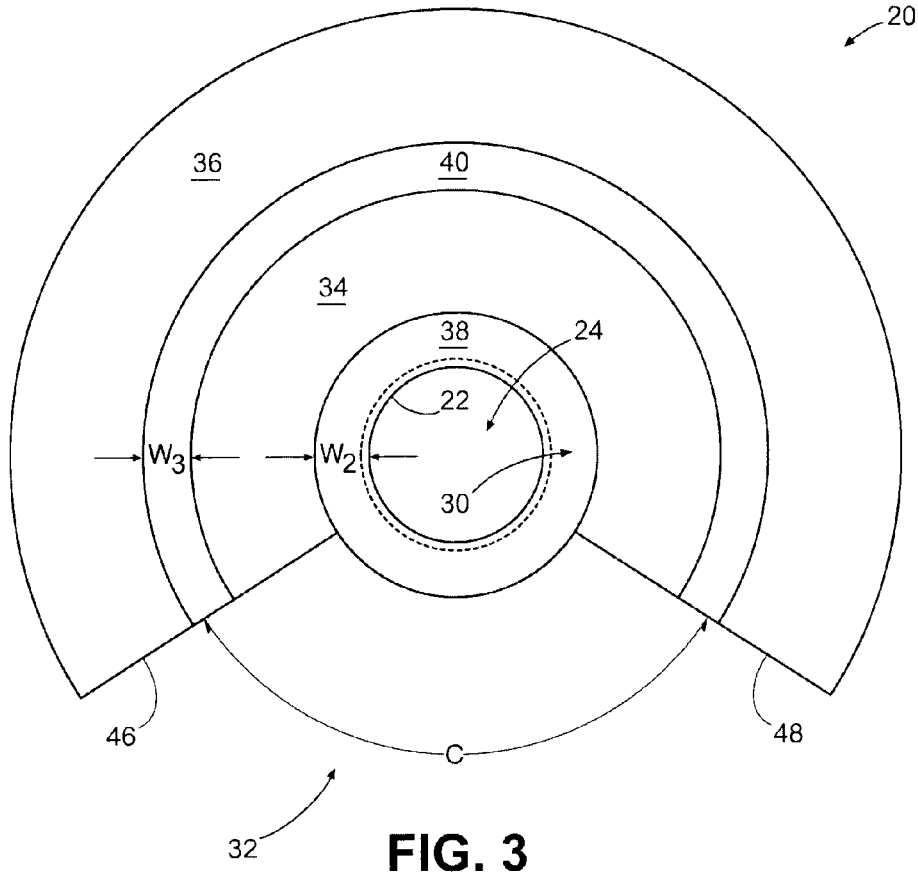
FIG. 3 is a plan view of the cup of FIG. 2.

FIG. 2 is a side view of an exemplary embodiment of a cup and FIG. 3 is a plan view of that cup. As shown, cup 20 includes an aperture 22 (e.g., a circular aperture) that communicates with a cavity 24. The cavity is defined by a wall 26, which is cylindrical in this embodiment, although various other shapes can be used. In this embodiment, the width ($W_1$) of the cavity is approximately 5 inches, and the depth (D) is approximately 5 inches (e.g., a depth that exceeds a diameter of the projectile). This embodiment also includes a bottom wall 28 although, in other embodiments, a bottom wall can be omitted.

A barrier 30 extends partially about the periphery of the aperture so that a lateral entrance 32 to the cavity is formed. In this embodiment, the barrier exhibits a height (H) of approximately 2½ inches. The barrier includes a base 33, an upwardly and outwardly sloping first portion 34 and a downwardly and outwardly sloping second portion 36. Note that, in this embodiment, the bottom wall 28 extends below the base 33.

An included angle (B) between the first portion of the barrier and the base is between approximately 5 and approximately 45 degrees, and an included angle (A) between the second portion of the barrier and the base is between approximately 5 and approximately 45 degrees. Preferably, the included angles (A and B) are approximately 30 degrees.

The first and second portions 34, 36 are frusto-conical segments, with the first portion 34 having a focal point ($f_1$) located on the same side of the aperture as the cavity (e.g., within the cavity), and the second portion 36 having a focal point ($f_2$) outside the cavity (e.g., on the opposite side of the aperture). Notably, the first portion is located between the second portion and the aperture.

A lip 38 is positioned between the first portion of the barrier and the aperture. In this embodiment, the aperture is positioned within a plane and the lip is oriented substantially perpendicular with respect to the plane. The lip in this embodiment exhibits a width ($W_2$) of approximately 1.5 inches. In some embodiments, a lip may not be included, while in others, a lip extending about only a portion of the aperture may be included. For instance, a lip may be positioned between the barrier and the aperture, but may be omitted between at locations corresponding to a lateral entrance.

A distal surface 40 is positioned between the first portion of the barrier and the second portion of the barrier. In this embodiment, the distal surface is an annular segment that oriented substantially parallel to the lip and exhibits a width ($W_3$) of approximately 1.5 inches. In other embodiments, distal surface distinct from the first and second portions of the barrier wall may be omitted.

With reference to FIG. 3, the barrier includes ends (42, 44) that are spaced from each other to form lateral entrance 32. An included angle (C) between the ends is approximately 120 degrees in this embodiment although, in other embodiments, different angles can be used, such as between approximately 45 and approximately 180 degrees. Optional end walls 46, 48 extending between the first and second portions can be used. It should also be noted that inner sides of the end walls can be positioned at various locations with respect to the aperture. In some embodiments, the walls may be set farther back than depicted in FIG. 3 (e.g., inner diameter edges of the end walls may be rear of a centerline of the aperture) to more effectively redirect the projectile toward the aperture.

It should also be noted that end walls may be oriented and/or configured in various manners. By way of example, the end walls may be inclined from bottom to top. Additionally or alternatively, the end walls may be inclined from respective outer diameter edges to respective inner diameter edges. The end walls, much like others of the surfaces, also may be curved.

Preferably, a cup is made of suitably rigid and weather resistant materials (e.g., injection molded plastic) to accommodate outdoor use. For instance, cups can be used at the beach, at which a cup can be pushed into the sand until the corresponding cavity is below the surface, with the aperture (and corresponding lip (if included)) being located at surface level (FIG. 1).

Figure 4:
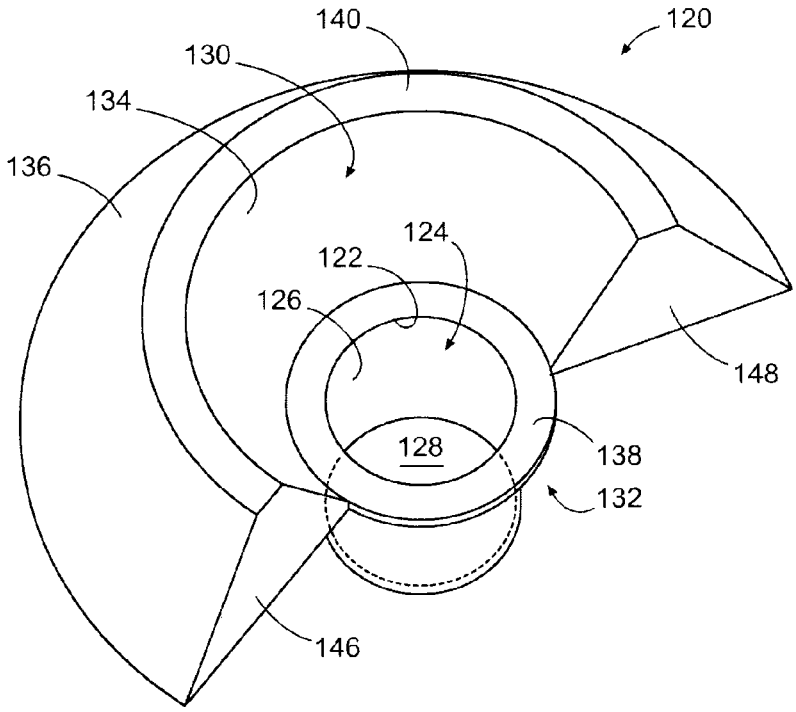
FIG. 4 is a perspective view depicting the top of another exemplary embodiment of a cup.
Figure 5:
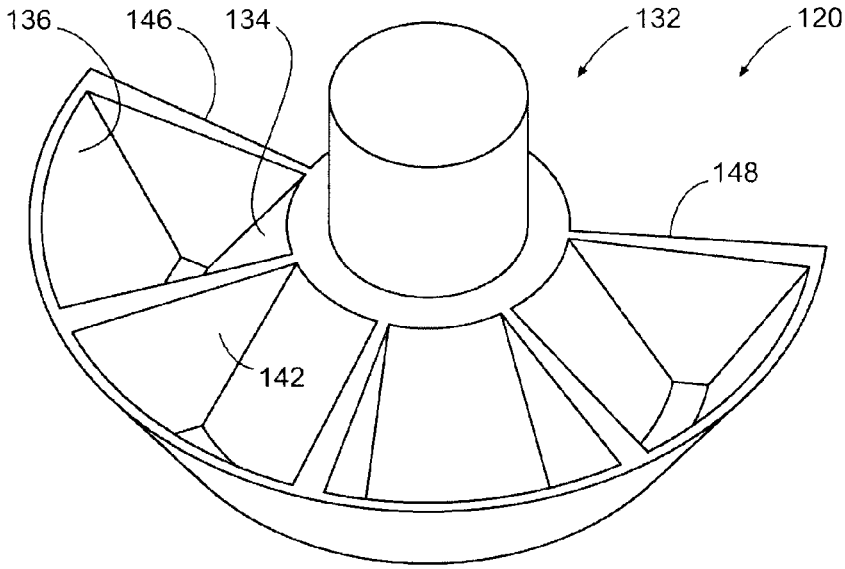
FIG. 5 is a perspective view depicting the bottom of the embodiment of FIG. 4.

FIGS. 4 and 5 are perspective views depicting the top and bottom, respectively, of another exemplary embodiment of a cup. As shown, cup 120 includes an aperture 122 that communicates with a cavity 124. Side wall 126 and bottom wall 128 define cavity 124.

A barrier 130 extends partially about the periphery of aperture 122 to form a lateral entrance 132. Barrier 130 includes a first portion 134 and a second portion 136, with the first portion being located between the second portion and the aperture. End walls 146, 148 of the barrier form the lateral entrance 132.

An annular lip 138 is positioned between the first portion 134 of the barrier and the aperture 122. Additionally, a distal surface 140 is positioned between the first portion of the barrier and the second portion of the barrier.

As shown in FIG. 5, this embodiment is a relatively thin-walled structure that incorporates structural ribs (e.g., rib 142). The ribs extend between the underside surfaces of the first and second portions of the barrier. Clearly, other forms of support (such as those that do not incorporate the use of ribs) can be used in other embodiments.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A cup comprising:

an aperture communicating with a cavity;

a barrier extending partially about the periphery of the aperture such that a portion of the cup lacking the barrier forms a lateral entrance to the cavity, the barrier having an upwardly and outwardly sloping first portion and a downwardly and outwardly sloping second portion, the first portion being located between the second portion and the aperture; and a lip positioned between the first portion of the barrier and the aperture.

2. The cup of claim 1, wherein the aperture is positioned within a plane and the lip is oriented substantially perpendicular with respect to the plane.

3. The cup of claim 1, further comprising a distal surface positioned between the first portion of the barrier and the second portion of the barrier.

4. The cup of claim 3, wherein the distal surface is oriented substantially parallel to the lip.

5. The cup of claim 1, further comprising a distal surface positioned between the first portion of the barrier and the second portion of the barrier.

6. The cup of claim 1, wherein the first portion of the barrier is a frusto-conical segment having a focal point located on the same side of the aperture as the cavity.

7. The cup of claim 1, wherein the first portion of the barrier is a frusto-conical segment having a focal point located within the cavity.

8. The cup of claim 1, wherein the second portion of the barrier is a frusto-conical segment having a focal point located outside the cavity.

9. The cup of claim 1, wherein the barrier has a base and an included angle between the first portion of the barrier and the base is between approximately 5 and approximately 45 degrees.

10. The cup of claim 1, wherein the barrier has a base and an included angle between the second portion of the barrier and the base is between approximately 5 and approximately 45 degrees.

11. The cup of claim 1, wherein the barrier has ends spaced from each other to form the lateral entrance, an included angle between the ends being between approximately 45 and approximately 180 degrees.

12. The cup of claim 11, wherein the ends include end walls extending between the first portion and the second portion.

13. The cup of claim 1, wherein the aperture is circular.

14. A game comprising:

a cup having an aperture communicating with a cavity, a lip positioned between the first portion of the barrier and the aperture, and a barrier extending partially about the periphery of the aperture such that a portion of the cup lacking the barrier forms a lateral entrance to the cavity, the barrier having an upwardly and outwardly sloping first portion and a downwardly and outwardly sloping second portion, the first portion being located between the second portion and the aperture; and a projectile sized to fit within the cavity via the aperture;

the cup being configured such that, as a base of the barrier is in contact with an upper surface of soil, the cavity extends below the upper surface of the soil to form a hole into which the projectile is directed.

15. The game of claim 14, wherein the projectile is a ball.

16. The game of claim 15, wherein the ball is a golf ball.

17. The game of claim 14, wherein a portion of the cup lacking the barrier forms a lateral entrance to the cavity, the barrier having an upwardly and outwardly sloping first portion and a downwardly and outwardly sloping second portion, the first portion being located between the second portion and the aperture.

18. The game of claim 14, wherein:

the cup is a first cup; and the game further comprises a second cup.

19. The game of claim 14, wherein the aperture is positioned within a plane and the lip is oriented substantially perpendicular with respect to the plane.

20. The game of claim 14, wherein:

the game further comprises a distal surface positioned between the first portion of the barrier and the second portion of the barrier; and the distal surface is oriented substantially parallel to the lip.

* * * * *